US009127499B2

(12) United States Patent
Lemons

(10) Patent No.: US 9,127,499 B2
(45) Date of Patent: Sep. 8, 2015

(54) COMPOSITE FRAME FOR AN OPENING

(75) Inventor: D. Todd Lemons, San Diego, CA (US)

(73) Assignee: Composite Technology International, Inc., Sacramento, CA (US)

( * ) Notice: Subject to any disclaimer, the term of this patent is extended or adjusted under 35 U.S.C. 154(b) by 1371 days.

(21) Appl. No.: 11/506,377

(22) Filed: Aug. 18, 2006

(65) Prior Publication Data

US 2007/0137118 A1 Jun. 21, 2007

Related U.S. Application Data

(60) Provisional application No. 60/710,037, filed on Aug. 19, 2005.

(51) Int. Cl.
*E06B 1/32* (2006.01)

(52) U.S. Cl.
CPC ..... *E06B 1/32* (2013.01)

(58) Field of Classification Search
USPC ..... 52/204.1, 656.2, 656.4, 656.5, 656.6, 52/656.7, 210, 211, 212, 215, 204.2, 52/311.1, 313, 316; 428/76; 49/504, 501, 49/DIG. 2
See application file for complete search history.

(56) References Cited

U.S. PATENT DOCUMENTS 1,566,863 A * 12/1925 Harrison ..... 428/496
1,879,005 A * 9/1932 Andersen ..... 52/213
2,317,635 A * 4/1943 Olsen ..... 52/281
3,080,257 A 3/1963 Berry
3,591,985 A * 7/1971 Coppins ..... 49/504
3,815,285 A * 6/1974 Kuyper ..... 49/501
3,968,614 A * 7/1976 Wallace ..... 52/204.1
4,402,170 A * 9/1983 Seidner ..... 52/631
4,791,771 A * 12/1988 Haugaard et al. ..... 52/656.5
4,979,346 A * 12/1990 Pollard ..... 52/656.2
5,072,547 A * 12/1991 DiFazio ..... 49/504
5,115,597 A * 5/1992 Tillery et al. ..... 49/504
5,212,921 A * 5/1993 Unruh ..... 52/204.1
5,448,869 A * 9/1995 Unruh et al. ..... 52/656.1
5,546,715 A * 8/1996 Edstrom ..... 52/215
5,569,713 A 10/1996 Lieberman
5,603,585 A * 2/1997 Bruchu et al. ..... 403/382
5,634,306 A * 6/1997 Riegelman ..... 52/309.16
5,651,223 A * 7/1997 Novak et al. ..... 52/211
5,661,943 A 9/1997 Hagel
5,687,518 A * 11/1997 Endo et al. ..... 52/204.1
5,758,458 A * 6/1998 Ridge ..... 52/204.1
5,873,209 A 2/1999 Hagel
5,901,510 A * 5/1999 Ellingson ..... 52/210
5,932,353 A 8/1999 Huarng et al.

(Continued)

OTHER PUBLICATIONS

Exterior Paint: Choosing the Right Paint, Jun. 4, 2003, Painting Your House, Last visited on Feb. 10, 2011 via Way Back Machine URL: http://web.archive.org/web/20030604071129/http://paintingyourhouse.info/exterior_paint.htm.*

(Continued)

*Primary Examiner* — Joshua J Michener
*Assistant Examiner* — Alp Akbasli
(74) *Attorney, Agent, or Firm* — Berkeley Law & Technology Group, LLP

(57) ABSTRACT

In accordance with one or more embodiments, a frame for an opening includes a first member, a second member, and a coating that is capable of facilitating bonding between the first member and the second member and also is capable of facilitating dimensional stability of the frame.

14 Claims, 6 Drawing Sheets

(56) References Cited

U.S. PATENT DOCUMENTS

| | | | | |
|---|---|---|---|---|
| 6,122,882 | A | 9/2000 | Hagel | |
| 6,218,023 | B1 | 4/2001 | DeNicola, Jr. et al. | |
| 6,282,851 | B1 * | 9/2001 | Beaton | 52/204.1 |
| 6,430,889 | B1 * | 8/2002 | Nixon, Sr. | 52/656.4 |
| 6,446,410 | B1 | 9/2002 | Hagel | |
| 6,604,334 | B2 * | 8/2003 | Rochman | 52/717.01 |
| 6,824,851 | B1 * | 11/2004 | Locher et al. | 428/76 |
| 7,059,092 | B2 * | 6/2006 | Harkins et al. | 52/232 |
| 7,487,591 | B2 * | 2/2009 | Harkins et al. | 29/897.312 |
| 2002/0046532 | A1 * | 4/2002 | Rochman | 52/656.4 |
| 2002/0069604 | A1 * | 6/2002 | Canfield | 52/656.4 |
| 2003/0037507 | A1 * | 2/2003 | Weza | 52/730.7 |
| 2004/0206022 | A1 * | 10/2004 | Panto | 52/204.1 |
| 2005/0193652 | A1 * | 9/2005 | Cornell | 52/204.1 |
| 2005/0281999 | A1 | 12/2005 | Hofmann et al. | |
| 2006/0175762 | A1 * | 8/2006 | Barnett et al. | 277/551 |
| 2007/0204534 | A1 * | 9/2007 | Lin et al. | 52/204.1 |
| 2008/0178553 | A1 | 7/2008 | Micho | |

OTHER PUBLICATIONS

Office action: Restriction Requirement mailed Jun. 13, 2008 in related U.S. Appl. No. 11/413,758, 6 pages.
Response filed Aug. 13, 2008 in related U.S. Appl. No. 11/413,758, 7 pages.
Office action: Restriction Requirement mailed Dec. 2, 2008 in related U.S. Appl. No. 11/413,758, 7 pages.
Response filed Feb. 26, 2009 in related U.S. Appl. No. 11/413,758, 7 pages.
Office action mailed Jun. 24, 2009 in related U.S. Appl. No. 11/413,758, 11 pages.
Examiner's Interview Summary mailed Oct. 13, 2009 in U.S. Appl. No. 11/413,758, 4 pages.
Amendment filed Oct. 21, 2009 in U.S. Appl. No. 11/413,758, 18 pages.
Final Office action mailed Nov. 9, 2009 in U.S. Appl. No. 11/413,758, 13 pages.
U.S. Appl. No. 60/710,037, filed Aug. 19, 2005.
U.S. Appl. 60/710,037, Notice to File Missing Parts, mailed Aug. 31, 2005, 2 pages.
U.S. Appl. No. 60/710,037, Notice to File Missing Parts Response, mailed Jan. 11, 2006, 8 pages.
U.S. Appl. No. 11/413,758, filed Apr. 27, 2006, 49 pages.
U.S. Appl. No. 11/413,758, Notice to File Missing Parts, mailed May 24, 2006, 2 pages.
U.S. Appl. No. 11/413,758, Notice to File Missing Parts Response, mailed Jul. 21, 2006, 18 pages.
U.S. Appl. No. 11/413,758, Notice of Informal Application, mailed Aug. 11, 2006, 1 page.
U.S. Appl. No. 11/413,758, Notice of Publication, mailed Nov. 1, 2007, 1 page.
U.S. Appl. No. 11/413,758, Examiner Interview Summary Record and Abandonment, mailed Jun. 8, 2010, 5 pages.
U.S. Appl. No. 12/907,938, filed Oct. 19, 2010, 33 pages.
U.S. Appl. No. 12/907,938, Notice to File Missing Parts and Filing Receipt, mailed Nov. 5, 2010, 5 pages.
U.S. Appl. No. 12/907,938, Notice to File Missing Parts Response, mailed Dec. 7, 2010, 5 pages.
U.S. Appl. No. 12/907,938, Filing Receipt, mailed Dec. 14, 2010, 3 pages.
U.S. Appl. No. 14/218,625: Final Rejection, mailed May 21, 2015, 12 pages.

* cited by examiner (SECTION A-A)

COMPOSITE FRAME FOR AN OPENING

CROSS-REFERENCE TO RELATED APPLICATIONS

This is patent application claims the benefit under 35 U.S.C. §119(e) of U.S. Provisional Application Ser. No. 60/710,037, filed on Aug. 19, 2005 titled "Composite Frame for an Opening."

BACKGROUND

1. Technical Field

The disclosure generally relates to frames around openings.

2. Information

Various structures may include one or more openings such as, but not limited to, doorways (internal and/or external), windows, skylights, ventilations, etc. For example, a house may have an opening for a doorway. Continuing with the example of the house, the opening may include a frame, where the frame may comprise jambs, on one of which, a door may be hung. The frame for a door having the jambs may be commonly referred to as a door jamb. A thin piece of material may be attached to the internal surface of the door jamb to provide a stop. Commonly, staples attach the stop to the doorjamb.

The process of placing the door jamb into the opening of the door way may involve positioning the door jamb within the opening, ensuring that the door jamb is level relative to horizontal and vertical references, shimming (i.e., utilizing thin pieces of material for alignment) the door jamb, and sealing and cosmetically finishing (i.e., calking) the doorjamb and the stop.

A common material for a door jamb may be a rigid material such as wood. The wood utilized for doorjambs may be of higher grade of wood to provide a relatively long and straight piece of wood such as jamb stock. Additionally, a higher grade of wood may also be utilized for the stop such as jamb stock, where the stop may be a thin piece of wood attached to the internal surfaces of the doorjamb by staples as previously described.

Higher grade of wood may be relatively expensive as compared with lower grade of wood and may further to produce waste wood. Further, higher grade of wood may still not provide dimensional stability to the frame. That is, jamb stock may still vary from frame to frame, and accordingly, may have a detrimental effect on installation of the frame within an opening.

BRIEF DESCRIPTION OF THE DRAWINGS

Embodiments are illustrated by way of example and not by way of limitation in the figures of the accompanying drawings, in which like references may indicate similar elements and in which.

DETAILED DESCRIPTION

In the following description, embodiments will be disclosed. For purposes of explanation, specific numbers, materials, and/or configurations are set forth in order to provide a thorough understanding of the embodiments. However, it will also be apparent to one skilled in the art that the embodiments may be practiced without one or more of the specific details, or with other approaches, materials, components, etc. In other instances, well-known structures, materials, and/or operations are not shown and/or described in detail to avoid obscuring the embodiments. Accordingly, in some instances, features are omitted and/or simplified in order to not obscure the disclosed embodiments. Furthermore, it is understood that the embodiments shown in the figures are illustrative representations and are not necessarily drawn to scale.

References throughout this specification to "one embodiment" or "an embodiment" means that a particular feature, structure, material, and/or characteristic described in connection with the embodiment is included in at least one embodiment. Thus, the appearances of the phrases "in one embodiment" and/or "in an embodiment" in various places throughout this specification are not necessarily all referring to the same embodiment. Furthermore, the particular features, structures, materials, and/or characteristics may be combined in any suitable manner in one or more embodiments.

For the purposes of the subject matter disclosed herein, frames may include a wide range of frames for openings such as, but not limited to, door ways, windows, skylights, ventilation openings, and the like. Accordingly, it should appreciated by those skilled in the art that that the shape of the frames may vary widely as well. That is, frames may be regular in geometric shape, may be irregular in geometric shape (e.g., a hexagonal shape, an octagonal shape, and so forth). However, for the purposes of describing the subject matter, references may be made to a frame for an opening for a door way, and subject matter is not limited to a type of frame and/or opening.

Figure 1A:
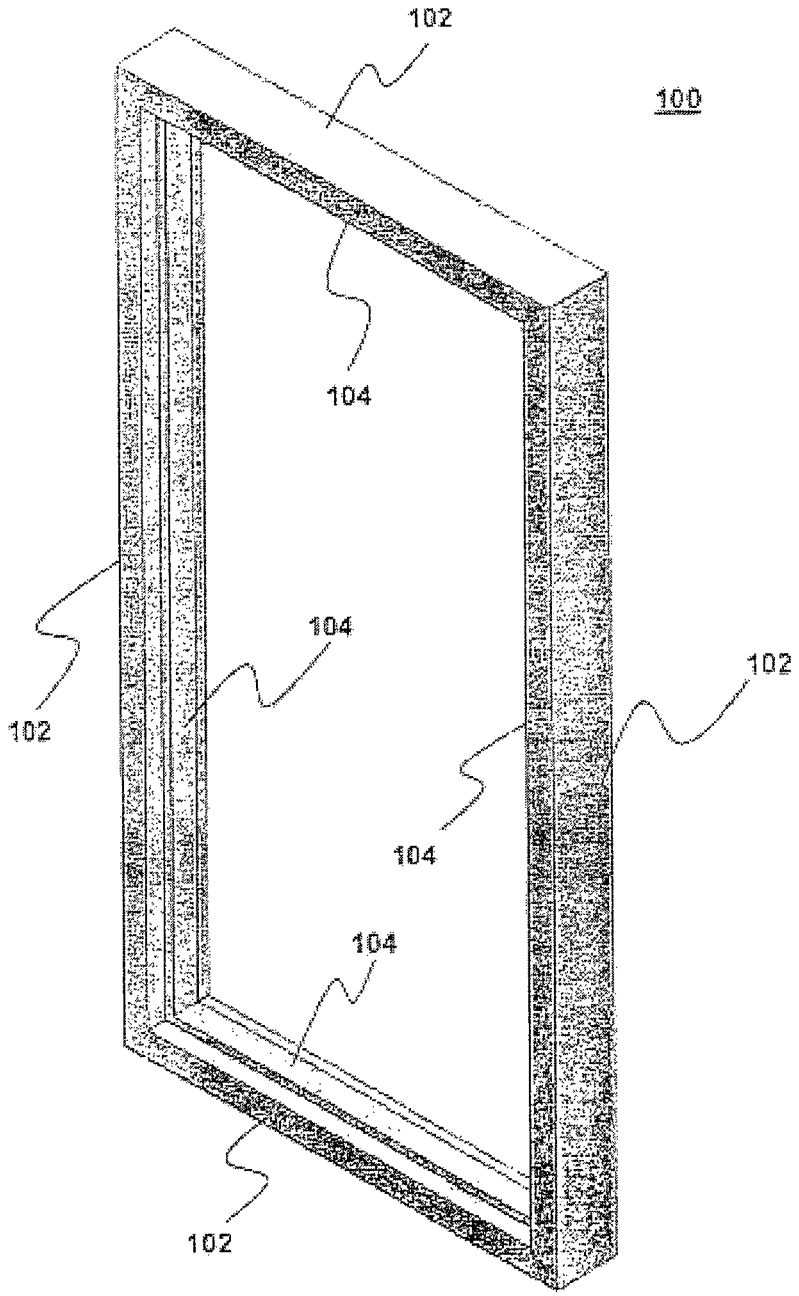
FIG. 1*a* illustrates a perspective view of an embodiment of a frame for an opening.

Turning now to the figures, FIG. 1*a* illustrates a perspective view of an embodiment of a frame for an opening. Frame 100 may comprise various members, such as a first member 102 and a second member 104. Varying lengths and/or numbers of the first member 102 and second member 102 may be utilized for frame 100. As illustrated in FIG. 1*a*, first member 102 may be utilized to form the outer boundaries of frame 100 and may form surfaces for the opening (not shown). For example, without limitations, first members 102 form outer boundaries of a frame for a door way, and accordingly, the first member 102 may be referred to as a jamb.

In FIG. 1*a*, even though frame 100 is illustrated as having four first members 102, it should be appreciated by one skilled in the art that any number of jambs may facilitate to form frame 100 such as, but not limited to, three first members 102 (e.g., two vertical jambs and a horizontal head jamb). Accordingly, the claimed subject matter is not limited in scope in these respects.

Continuing to refer to FIG. 1*a*, second member 104 may form a structure for a barrier for the opening such as, but not limited to, a stop for a door (i.e., a door stop). Accordingly, second member 104 may have a smaller cross-sectional area than the first member 102.

As previously described with respect to first member 102, it should also be appreciated by one skilled in the art that frame 100 may have any number of second members 104, and may correspond to the number of first members 102. Further, even though frame 100 is shown having approximately right angles, it should be appreciated by one skilled in the art that the angles may be approximately any type of angle appropriate for an opening based at least in part on the shape of the opening, and accordingly, the claimed subject matter is not limited in scope in these respects.

Illustrated in the embodiment of FIG. 1*a*, second member 104 may be disposed on the first member 102 and bonded along their respective lengths, thereby forming the frame 100 for the opening. In the embodiment of FIG. 1*a*, first member 102 and second member 104 appear to be integrated and substantially straight. However, as will be described in further detail, frame 100 may comprise a first member 102 and second member 104 comprising composite material having a coating that is capable of facilitating bonding between the first member 102 and second member 104 and capable of facilitating dimensional stability of frame 100. As previously alluded to, frame 100 may be any type of frame utilized for an opening such as, but not limited to, a door frame, a window frame, skylight frame, a ventilation frame, etc.

Figure 1B:
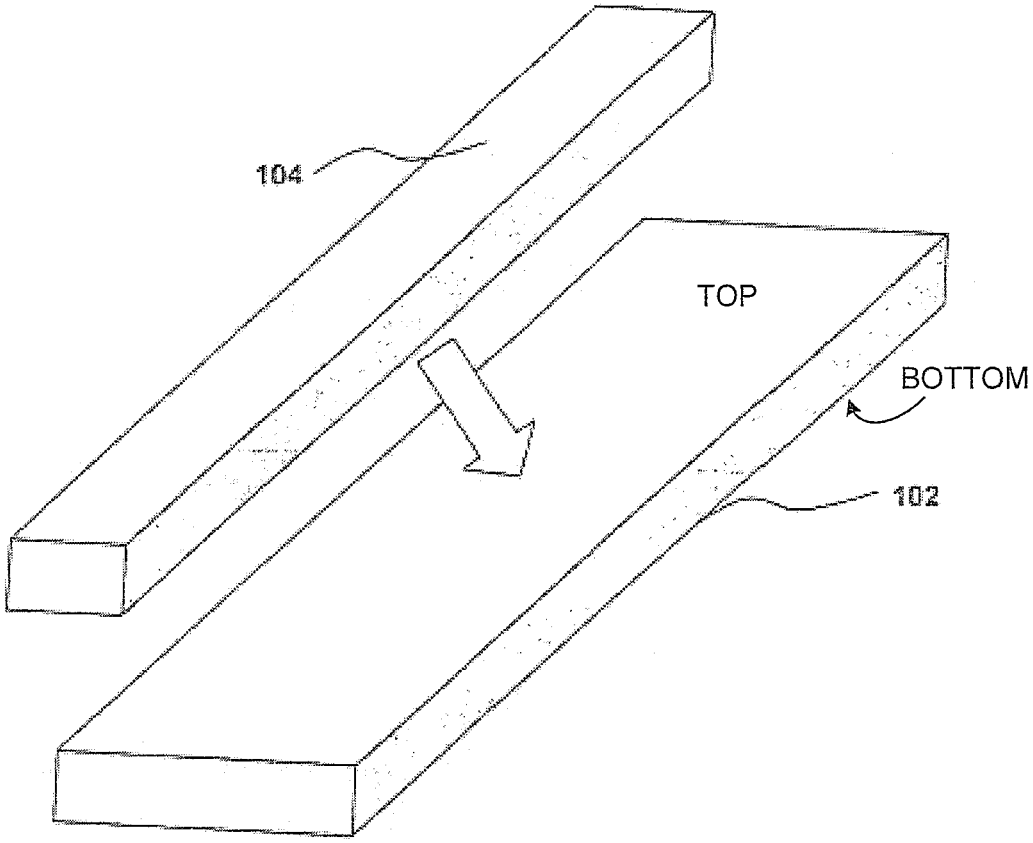
FIG. 1*b* illustrates a perspective view of an embodiment of a frame for an opening.

FIG. 1*b* illustrates a view of first member 102 and second member 104. In a particular embodiment, second member 104 may be disposed on first member 102 prior to bonding.

Figure 2B:
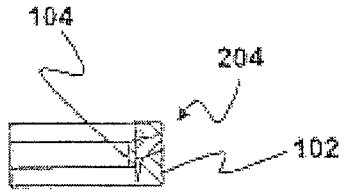
FIGS. 2A-2B illustrate a planar view and a section view of an embodiment of a frame for an opening.
Figure 2A:
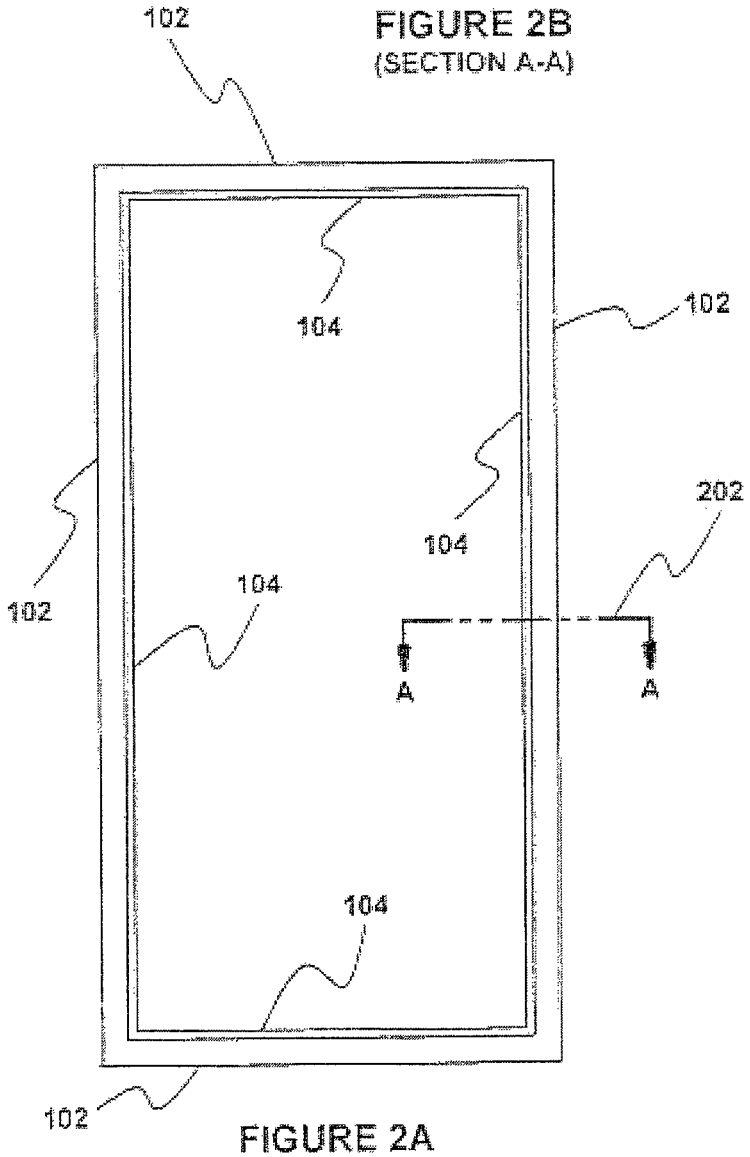

FIGS. 2A-2B illustrate a planar view and a section view of an embodiment of a frame for an opening. FIG. 2A illustrates a planar view of frame 100 showing first members 102 and second members 104. Additionally, in FIG. 2A, a section line 202 is shown to indicate a section A-A through first member 102 and second member 104 resulting in a section view 204 as illustrated in FIG. 2B. In FIG. 2B, section 204 includes a composition of materials forming first member 102 and second member 104 in accordance with an embodiment. Further, second member 104 may have a cross-sectional area that is smaller than the cross-sectional area of the first member 102.

Figure 3:
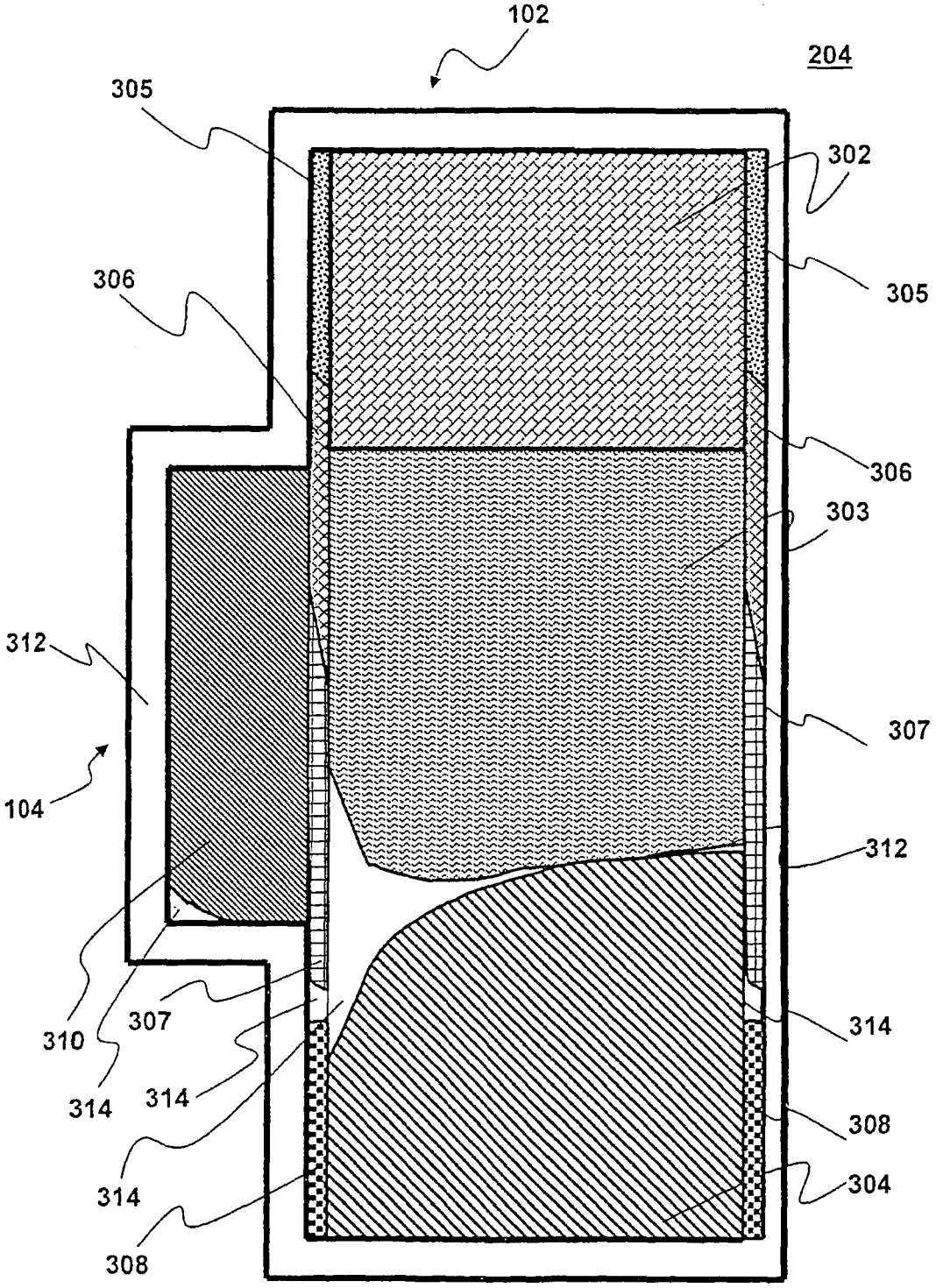
FIG. 3 illustrates a section view of an embodiment of a frame for an opening in detail.

FIG. 3 illustrates a section view of an embodiment of a frame for an opening in detail. In FIG. 3, section 204 (shown in FIG. 2B) through first member 102 and second member 104 is shown in greater detail. As shown in FIG. 3, first member 102 may comprise a number of materials 302-308 forming a composite like structure (i.e., first member 102), and second member 104 may comprise a single material 310. Further, first member materials 302-308 and second member material 310 may have irregular shapes.

Continuing to refer to FIG. 3, in the illustrated embodiment, first member 102 and second member 104 may be coated with a coating 312 that is capable of facilitating bonding between first member 102 and second member 104. As can be seen, even though first member 102 and second member 104 may comprise irregularly shaped materials, coating 312 may also facilitate dimensional stability of the frame 100 (shown in FIG. 1*a*). That is, coating 312 may be capable of facilitating an appropriate shape and structure for frame 100 to accommodate its respective opening and use (e.g., door frame for a door way). Again, it should be appreciated by one skilled in the art that the first and second members 102 & 104, may be any type of shape appropriate for the openings and its respective use, and accordingly, the claimed subject matter is not limited in scope in these respects.

Continuing to refer to FIG. 3, first member 102 may be formed of a composition of various materials such as, but not limited to, a hard fibrous material. Hard fibrous material may include a wide range of materials such as, but not limited to, wood type material. Further, first member 102 may be formed of a composition of irregularly shaped material as previously described in accordance with various embodiments. Additionally, second member 104 may also be formed of one or more various materials such as, but not limited to, hard fibrous material (e.g., wood type material). Here too, second member 104 may comprise a material having an irregular shape. The shape of first member materials 302-308 and second member material 310 are shown for illustrative purposes only, and accordingly, first member materials 302-308 and second member material 316 may have any type of shapes such as, but not limited to, all having regular shapes, some having regular shapes with some having irregular shapes, and so forth, and the claimed subject matter is not limited in scope in these respects. Further, first member 102 may have a cross-sectional are that is larger than the second member 104 as illustrated by FIG. 3.

As shown in the embodiment of FIG. 3, because of the wide variety of shapes and sizes of materials 302-308 & 310 that may form first member 102 and second member 104, first member 102 and/or second member 104 may have one or more non-material areas 314. Non-material areas 314 may be any type of non-material area such as, but not limited to, a gap, a filler type of material, etc., and accordingly, the claimed subject matter is not limited in scope in these respects. Additionally, illustrated in the embodiment, materials 302-308 & 310 may be of different type. For example, without limitations, as shown by cross-hatchings, materials 302-308 & 310 may be of different types such as, but not limited to, different types of quality of wood type materials, plastic type materials, metal type materials, mineral type materials, ceramic type materials, so forth and any combination thereof.

In one embodiment, coating 312 may include a variety of coatings capable of facilitating bonding between the members 102 & 104 (i.e., jambs and stops) and capable of facilitating dimensional stability. For example, without limitations, coating 312 may comprise a resin type material such as, but not limited to, a polyvinyl acetate and/or ethylene vinyl acetate type material. Additionally, coating 312 may include structures, such as, but not limited to, substantially spherical type structures. For example, without limitations, coating 312 may include a water borne polyvinyl acetate type material having various surfactants, wetting agents, plasticizers, and glass microspheres such as, but not limited to, glass bubbles available from 3M Co. of St. Paul, Minn., and accordingly, the subject matter, is not limited in these respects. Additionally, in one embodiment, materials 305-308 depicted in FIG. 3 represent examples of various veneers which may facilitate bonding between first member 102 and second member 104 and/or may comprise materials that may provide dimensional stability to a finished product. For example, without limitations, such materials may be for instance, a hard fibrous material composite and/or a composite resin type material and accordingly, the subject matter, is not limited in these respects. For example, a hard fibrous material or veneer is identified in FIG. 3 as items 305-308 and depicted as applied to opposing or top and bottom sides of material item 102.

Figure 4A:
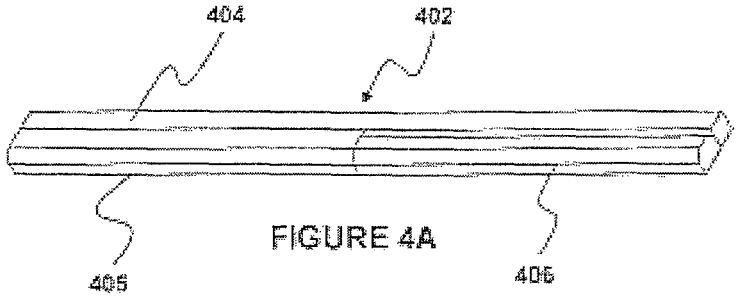
FIGS. 4A-4C illustrate one embodiment of a process for a frame for an opening.
Figure 4B:
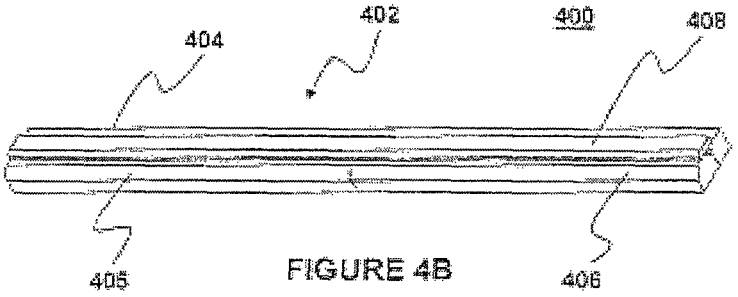
Figure 4C:
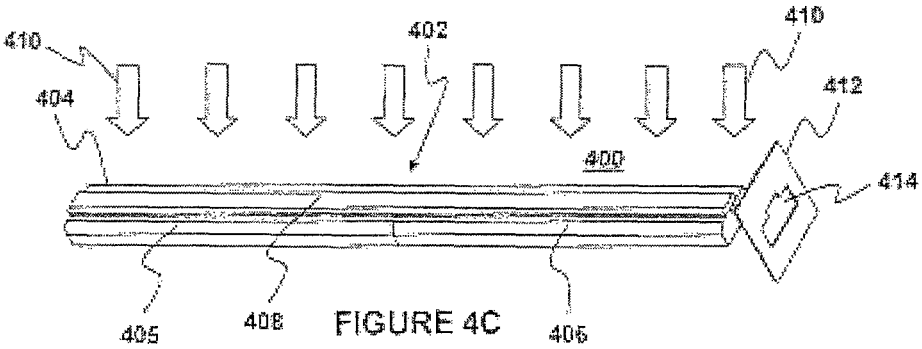

FIGS. 4A-4C illustrate one embodiment of a process for a frame for an opening. Shown in FIG. 4A, a first member 402 may comprise a number of materials 404-406. Additionally, each material 404-406 may be irregular in shape. Together, materials 404-406 may form approximately a polygonal type shape based at least in part on the type of opening a frame is to be utilized. For example, without limitations, for an opening for a door way, an approximate polygon may be in the form of a regular shape such as, but not limited to, an approximate rectangular shape. Accordingly, first member 402 may form a jamb type structure for the opening, where materials 404-406 may be of a hard fibrous type material such as, but not limited to, a wood type material, as previously described.

Turning now to FIG. 4B, an assembly 400 may comprise a first member 402 and a second member 408, where second member 408 is shown disposed on first member 402. Second member 408 may comprise a single piece of material and/or may comprise more than one piece of material. Here again, second member 408 may be irregular in shape, and second member 408 may form approximately a polygonal type shape based at least in part on the type of opening the frame 100 is to be utilized. That is, as shown in FIG. 4B, second member 408 may be utilized for an opening for a door way, and accordingly, without limitations, second member 408 may have an approximately rectangular shape and may form a stop type structure for the opening. Accordingly, second member 408 may also be of a hard fibrous type material such as, but not limited to, a wood type material and have a sectional area that is smaller than the sectional area of the first member 402 as previously described.

It should be appreciated by one skilled in the art that materials 404-406 and second member 408 may be held together in a wide range of approaches such as, but not limited to, various joining techniques (e.g., without limitations, dado, butt, mitered, mortise, and so forth) including adhesive based approaches such as, but not limited to, providing a thin layer of material such as a veneer and/or materials similar to the materials 305-308 shown in FIG. 3, and the claimed subject matter is not limited to a particular approach.

Once the second member 408 is disposed on first member 402, coating 410 may be applied to assembly 400 as illustrated in FIG. 4C. Coating 410 may be applied in a wide variety of approaches such as, but not limited to, continuous type coating approaches commonly found in assembly line type manufacturing approaches, a dipping type of approach, a spray type approach, a molding type approach, and so forth, and the claimed subject matter is not limited to a particular approach. Continuing to refer to FIG. 4C, once coating 410 has cured to a predetermined consistency, a forming device 412 may be applied. Forming device 412 may provide a shape that approximates the finished product. For example, without limitations, forming device 412 may be utilized to extrude assembly 400 having coating 410 through an opening 414, where opening 414 may have a dimension that provides a predetermined thickness for coating 410, such as, but not limited to, 0.125 inches. In another embodiment, assembly 400 may reside within a mold (not shown) having the shape that approximates the finished product. Accordingly, once coating 410 has cured to a predetermined consistency, assembly 400, having coating 410, may be released from the mold.

As previously alluded to, thickness of coating 410 on the finished assembly 400 may vary based at least in part on the irregularity of materials 404-406 & 408. For example, without limitations, the thickness of coating 410 may vary based at least in part on straightness of the materials 404-406 & 408 and/or surface quality of the materials 404-406 & 408. Additionally, coating 410 may be capable of facilitating bonding between the first member 402 and the second member 408. Accordingly, coating 410 is capable of facilitating bonding between the first member 402 and second member 408 and is also capable of facilitating dimensional stability. That is, dimensional stability may be referred herein to providing appropriate dimensions for a finished frame, even from irregular materials, and may further refer to capabilities of maintaining appropriate dimensions. For example, without limitations, coating 410 may be capable of reducing environmental effects on the frame 100 such as, but not limited to, moisture, heat, sunlight, etc. Additionally, coating 410 may also be capable of reducing mechanical effects on the frame 100 such as, but not limited to, impact, tensile stress, compression, and so forth. As previously described, coating 410 may include a variety of materials to facilitate appropriate properties.

Figure 5:
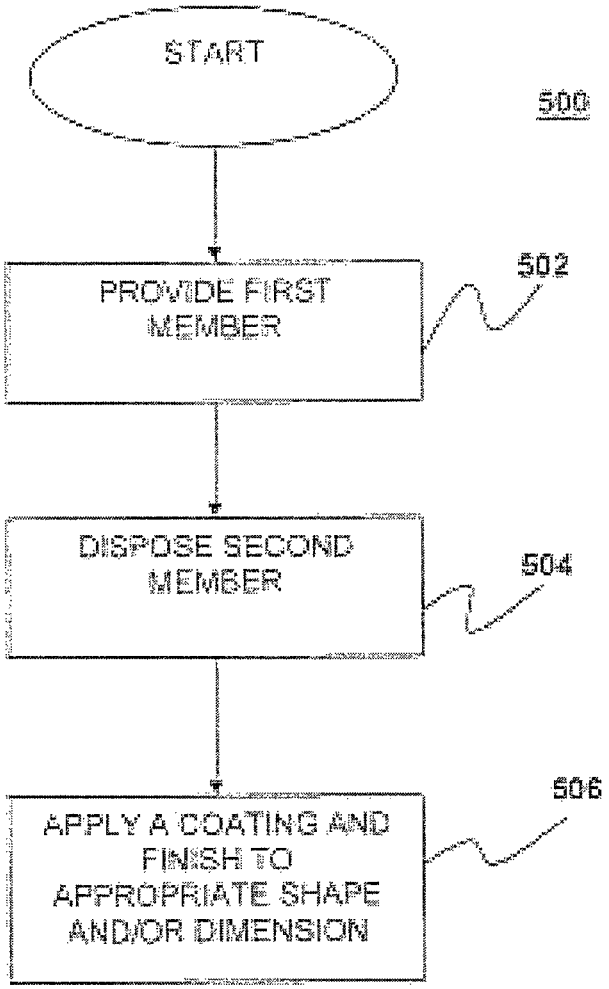
FIG. 5 illustrates a flow chart of one embodiment of a process for a frame for an opening.

FIG. 5 illustrates a flow chart of one embodiment of a process for producing a frame for an opening. As illustrated by flow chart 500 in FIG. 5, the process may start by providing a first member, as indicated by block 502. As previously described, first member may comprise a wood type material that may be utilized to form jamb portions of a frame. Additionally, first member may comprise a number of irregularly shaped and/or regularly shaped hard fibrous material (e.g., wood type material). Further, the first member may have a sectional area that may be of a polygonal shape, and for example, without limitations, an approximately rectangular shape.

At block 504, a second member is disposed on the first member, where the second member has a sectional area that may also be of a polygonal shape and be less than the sectional area of the first member. Additionally, second member may comprise one or more hard fibrous material such as, but not limited to wood type material as previously described. Further, as previously described, second member may comprise a wood type material that may be utilized to form stop portions of a frame.

In the embodiment of FIG. 5, first and second members are coated and shaped, as indicated by block 506. The coating may be capable of facilitating bonding between the first and second members. As previously described, the finishing may be performed with the utilization of a device having the appropriate shape and/or dimension. Additionally, as previously described, coating may be capable of also facilitating dimensional stability of the frame.

While there has been illustrated and/or described what are presently considered to be example embodiments of claimed subject matter, it will be understood by those skilled in the art that various other modifications may be made, and/or equivalents may be substituted, without departing from the true scope of claimed subject matter. Additionally, many modifications may be made to adapt a particular situation to the teachings of claimed subject matter without departing from subject matter that is claimed. Therefore, it is intended that the patent not be limited to the particular embodiments disclosed, but that it covers all embodiments falling within the scope of the appended claims.

What is claimed is:

1. A frame for an opening comprising: a composite comprising:

at least one first member comprising a composite material;

at least one second member coupled to the first member, the second member comprising one or more materials; and an at least partially blended composite coating disposed over the first and the second members, the coating capable of providing structural support to the frame.

2. The apparatus of claim 1, wherein the coating is further capable of facilitating bonding between the first and second members.

3. The apparatus of claim 1, wherein the coating is further capable of facilitating dimensional stability of the frame.

4. The frame for an opening of claim 1, wherein the coating comprises any number or combination of the following: resin, substantially spherical structures, glass objects, polyvinyl acetate, a surfactant, glass micro spheres or a wetting agent.

5. The frame for an opening of claim 1, further comprising any number of first members or any number of the second members.

6. The frame for an opening of claim 1, wherein the composite material further comprises any number or combination of the following: a metallic material, a mineral material, a ceramic material, a plastic material or a hard fibrous material.

7. The frame for an opening of claim 1, wherein the any number or combination of materials further comprises any number or combination or composite of the following: a metallic material, a mineral material, a ceramic material, a plastic material or a hard fibrous material.

8. The frame for an opening of claim 1, further comprising an adhesive capable of coupling the second member to the first member.

9. The frame for an opening of claim 1, wherein the frame comprises a door frame, and wherein the coating is further capable of providing structural support to the door frame.

10. A frame for an opening comprising: a composite comprising:

at least one first member, the first member having a sectional area and comprising a first one or more materials;

at least one second member disposed on the first member, the second member having a sectional area less than the sectional area of the first member and comprising a second one or more materials; and an at least partially blended composite coating disposed over the first and the second members, the coating capable of facilitating bonding between the first and the second members or capable of facilitating dimensional stability of the frame;

wherein the frame comprises a door frame and wherein the coating is further capable of providing structural support to the door frame.

11. A frame for an opening comprising: a composite comprising:

at least one first member comprising a top surface, the first member further comprising a composite material;

at least one veneer disposed on the top surface of the first member;

at least one second member coupled to the veneer, the second member comprising one or more materials; and an at least partially blended composite coating disposed over the first and the second members and the veneer, the coating capable of providing structural support to the frame.

12. The frame for an opening of claim 11, wherein said veneer comprises a composite of hard fibrous material.

13. A frame for an opening comprising: a composite comprising:

at least one first member comprising a top surface and a bottom surface, the first member further comprising a composite material;

a first veneer disposed on the top surface of the first member;

a second veneer disposed on the bottom surface of the first member;

at least one second member coupled to the first veneer, the second member comprising one or more materials; and an at least partially blended composite coating disposed over the first and the second members and the first and second veneers, the coating capable of providing structural support to the frame.

14. The frame for an opening of claim 13 wherein said first veneer or said second veneer, comprise a composite of hard fibrous material.

* * * * *

UNITED STATES PATENT AND TRADEMARK OFFICE

CERTIFICATE OF CORRECTION

PATENT NO. : 9,127,499 B2
APPLICATION NO. : 11/506377
DATED : September 8, 2015
INVENTOR(S) : D. Todd Lemons It is certified that error appears in the above-identified patent and that said Letters Patent is hereby corrected as shown below:

Claims

Column 6, line 54, In claim 2, line 1 replace “apparatus” with --frame--.

Column 6, line 57, In claim 3, line 1 replace “apparatus” with --frame--.

Signed and Sealed this
Eighth Day of March, 2016

Michelle K. Lee

Michelle K. Lee
*Director of the United States Patent and Trademark Office*